US005247335A

United States Patent [19]

Smith et al.

[11] Patent Number: 5,247,335

[45] Date of Patent: Sep. 21, 1993

[54] DEVELOPED IMAGE TRANSFER ASSIST APPARATUS HAVING A CAM MECHANISM

[75] Inventors: Robin E. Smith, Webster; James D. Apolito, Rochester; George F. Rittberg, Macedon; David K. Ahl, Rochester; Dan F. Lockwood, Ontario, all of N.Y.

[73] Assignee: Xerox Corporation, Stamford, Conn.

[21] Appl. No.: 933,639

[22] Filed: Aug. 24, 1992

[51] Int. Cl.[5] ..... G03G 15/14

[52] U.S. Cl. ..... 355/271; 355/277

[58] Field of Search ..... 355/271, 282, 285, 289, 355/290, 277, 200

[56] References Cited

U.S. PATENT DOCUMENTS 2,807,233 9/1957 Fitch ..... 118/638
2,909,971 10/1959 Barber ..... 118/638
4,947,214 8/1990 Baxendell et al. ..... 355/274
5,075,734 12/1991 Durland et al. ..... 355/312
5,153,652 10/1992 Zoltner ..... 355/273

*Primary Examiner*—R. L. Moses

[57] ABSTRACT

An apparatus for enhancing contact between a copy sheet and a developed image positioned on a photoconductive member includes a cam movable between a first position and a second position. The apparatus further includes a mechanism for moving the cam between its first position and its second position. Additionally, the apparatus includes a contact member being spaced apart from the copy sheet in a first mode of operation and being in contact with the copy sheet in a second mode of operation. Moreover, the apparatus includes a mechanism for positioning the contact member in its first mode of operation in response to the cam being moved to its first position, and in its second mode of operation in response to the cam being moved to its second position.

4 Claims, 4 Drawing Sheets

DEVELOPED IMAGE TRANSFER ASSIST APPARATUS HAVING A CAM MECHANISM

CROSS REFERENCE

Cross reference is made to copending U.S. patent application Ser. No. 07/755,412, entitled "Transfer Blade in an Electronic Reprographic Printing System" by R. Smith et al, and assigned to the same assignee as the present invention.

The present invention relates generally to an apparatus for assisting transfer of a developed image from a photoconductive member to a copy sheet, and more particularly concerns an apparatus for enhancing contact between a copy sheet and a developed image positioned on a photoconductive member.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing marking particles into contact therewith. Generally, the developer material is made from toner particles adhering triboelectrically to carrier granules. The toner particles are attracted from the carrier granules to the latent image forming a toner particle image on the photoconductive member. The toner image (or developed image) is then electrostatically transferred from the photoconductive member to a copy sheet. Heat is then applied to the toner image to permanently affix the toner image to the copy sheet in image configuration.

With regard to the electrostatic transfer process, the copy sheet is moved into contact with the photoconductive member, in synchronism with the toner image developed thereon. The copy sheet then adheres to the photoconductive member with the toner image being interposed between the photoconductive member and the copy sheet. A problem may occur in the transfer process when spaces or gaps exist between the developed image on the photoconductive member and the copy sheet. These spaces are sometimes caused by deformations or wrinkles in the copy sheet or by an excessive build up of toner particles on the photoconductive member. In the process of transferring the developed toner image to the copy sheet, it is desirable for the copy sheet to be in substantial uniform contact with the toner image developed on the photoconductive member. Failure to do so may result in variable transfer efficiency and, in extreme cases, areas of low or no transfer resulting in image deletions. An image deletion is obviously very undesirable in that useful information or indicia is not reproduced on the copy sheet.

One system that has been designed to reduce the occurrence of image deletions utilizes a blade which is brought into contact with the backside of a copy sheet during the electrostatic transfer process. An example of such a system is disclosed in U.S. Pat. No. 4,947,214 issued to Baxendell et al. The above design requires raising a blade into contact with a copy sheet and then subsequently lowering the blade away from the copy sheet. The force needed to raise and lower the blade is provided by a solenoid which is mechanically coupled to the blade by a mechanical linkage.

In accordance with one aspect of the present invention, there is provided an apparatus for enhancing contact between a copy sheet and a developed image positioned on a member. The apparatus comprises a cam movable between a first position and a second position. Means are provided for moving the cam between the first position and the second position. A contact member is spaced apart from the copy sheet in a first mode of operation and is in contact with the copy sheet in a second mode of operation. Means position the contact member in the first mode of operation in response to the cam being moved to the first position, and in the second mode of operation in response to the cam being moved to the second position.

Pursuant to another aspect of the present invention, an apparatus for enhancing contact between a copy sheet and a developed image positioned on a member comprises a cam, and a contact member positionable to contact the copy sheet so as to urge the copy sheet toward the developed image. Means are provided for transmitting mechanical force from the cam to the contact member. The transmitting means includes a cam follower which contacts the cam.

Other features of the present invention will become apparent as the following description proceeds and upon reference to the drawings, in which.

Figure 1:
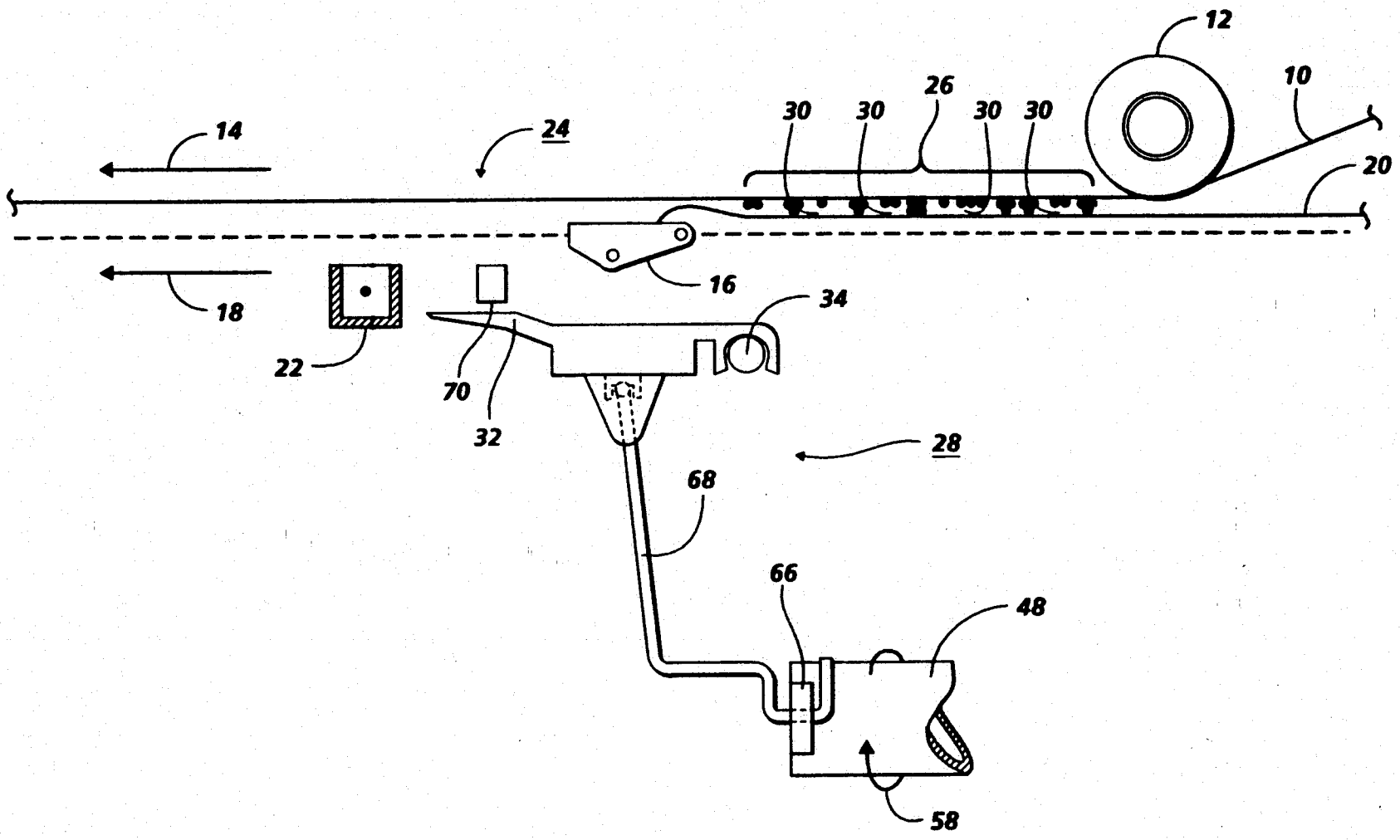
FIG. 1 is a schematic elevational view showing the sheet being transported over the contact enhancing mechanism (partially shown) which incorporates features of the present invention therein, with the contact enhancing mechanism being shown in its first mode of operation.
Figure 4:
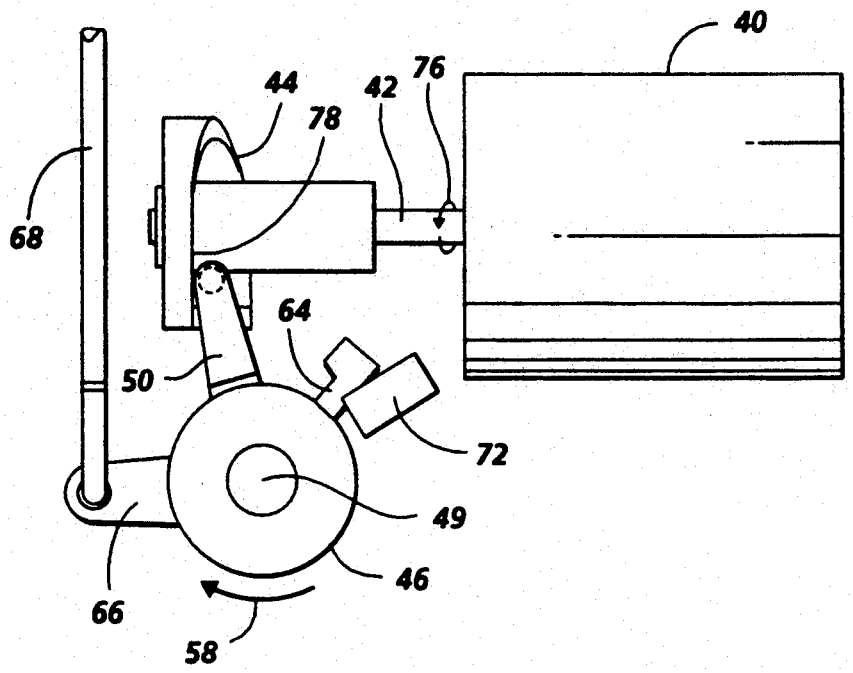
Figure 5:
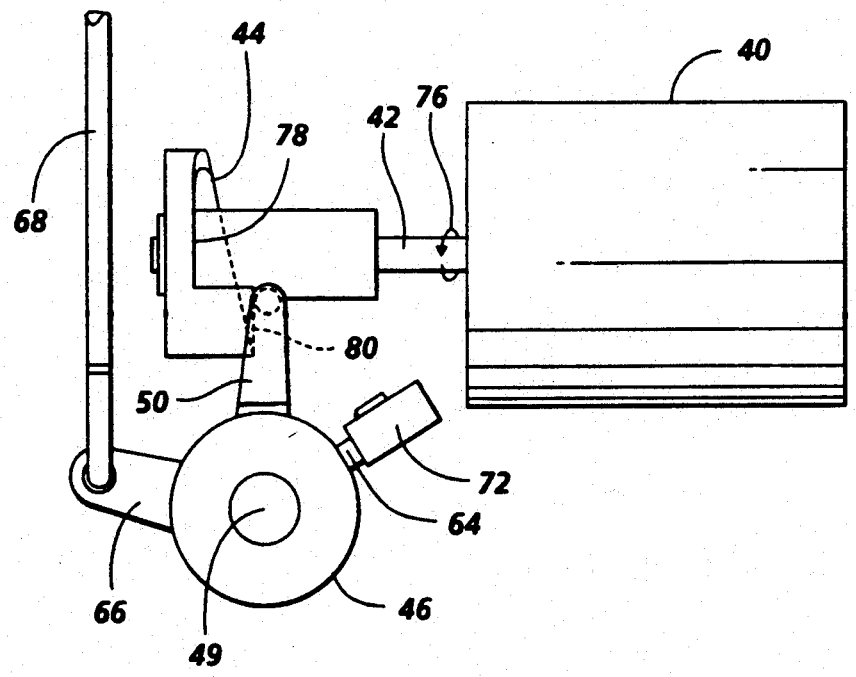

FIG. 4 is a side elevational view showing the cam member of the contact enhancing mechanism of FIG. 1 positioned at its first position thereby causing the cam follower, the sensor flag and the link arm to be positioned at a corresponding position, with certain components of the contact enhancing mechanism omitted for clarity of description; and FIG. 5 is a side elevational view showing the cam member of the contact enhancing mechanism of FIG. 1 positioned at its second position thereby causing the cam follower, the sensor flag and the link arm to be positioned at a corresponding position, with certain components of the contact enhancing mechanism omitted for clarity of description.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further applications of the principles of the invention as illustrated therein being contemplated as would normally occur to one skilled in the art to which the invention relates.

In FIG. 1 of the drawings, there is shown a photoconductive member 10. The photoconductive member is entrained about a plurality of rollers (only one roller is shown, i.e. roller 12). The photoconductive member 10 is advanced in the direction of arrow 14 in a recirculating path of movement. The photoconductive member 10 has a developed image (or toner image) 26 electrostatically secured thereto. A sheet gripper 16 is shown advancing a sheet 20 adjacent to the photoconductive member 10 in the direction of arrow 18. The sheet 20 is electrostatically attracted to the photoconductive member 10. FIG. 1 further shows the developed image 26 interposed between the advancing photoconductive member 10 and the advancing sheet 20. The above arrangement of photoconductive member 10 and sheet gripper 16 may be used in a multi-color electrophotographic printing machine such as the printing machine disclosed in U.S. Pat. No. 5,075,734 issued to Durland et al., the disclosure of which is hereby incorporated by reference. Also, the sheet gripper 16 may be used with the sheet transport system disclosed in the above patent to Durland et al. Referring again to FIG. 1, a corona generating device 22 is positioned near the photoconductive member 10 and defines a transfer zone 24. Positioned before the corona generating device 22, relative to the direction of movement of the sheet gripper 16, is a contact enhancing mechanism, generally indicated by the reference numeral 28 (partially shown in FIGS. 1 and 2). The contact enhancing mechanism functions to enhance contact between the sheet 20 and the developed image 26 so as to improve the quality of transfer of the developed image 26 from the photoconductive member 10 to the sheet 20. The contact enhancing mechanism 28 includes a first sensor 70 and a blade 32 which is pivotable about a stationary shaft 34.

Figure 2:
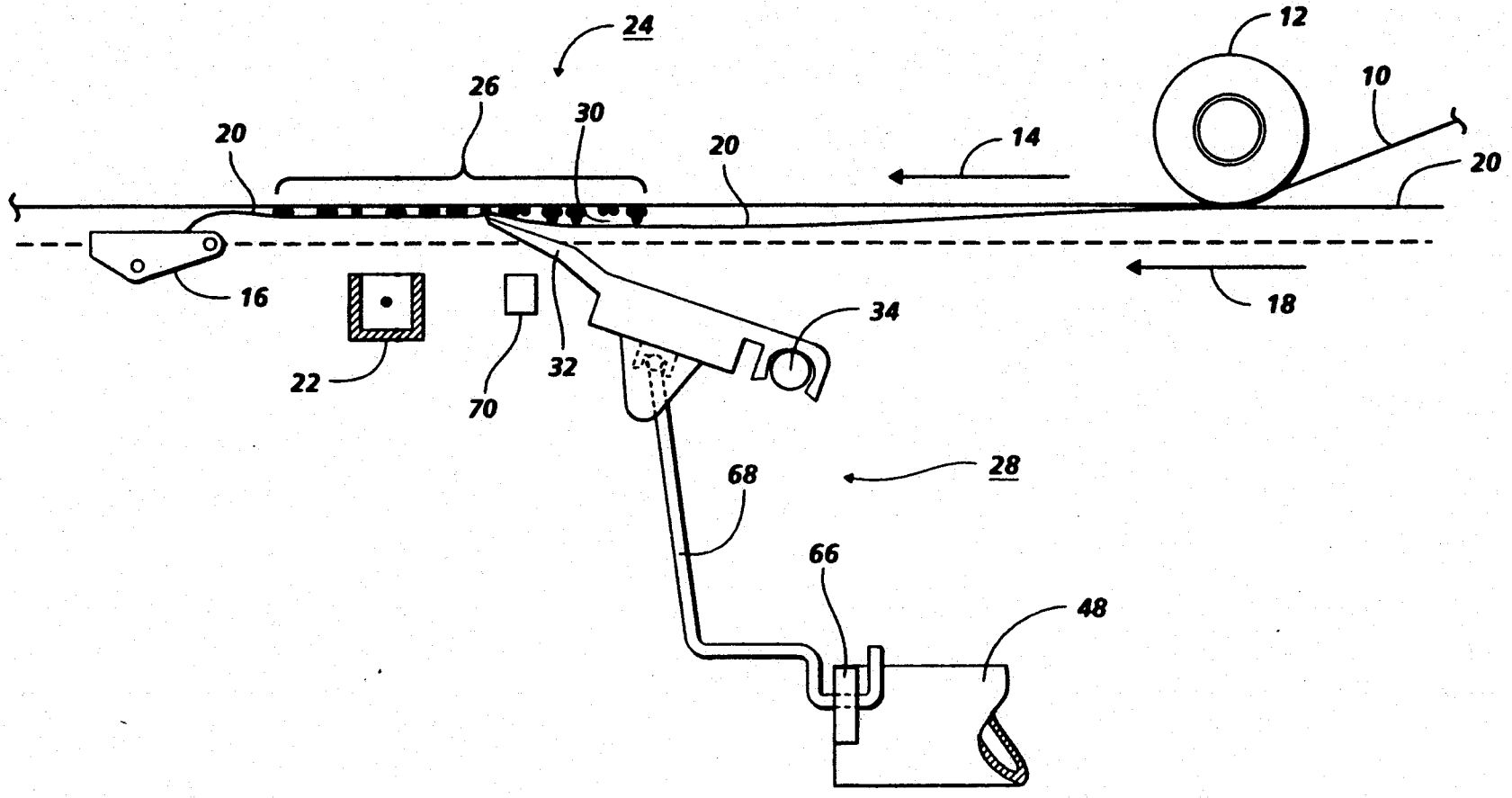
FIG. 2 is a schematic elevational view showing the sheet being transported over the contact enhancing mechanism of FIG. 1, with the contact enhancing mechanism being shown in its second mode of operation.

FIGS. 1 and 2 depict the movement of the sheet gripper 16 as it transports the sheet 20 through the transfer zone 24. More specifically, FIG. 1 shows sheet gripper 16 just prior to passing completely over the contact enhancing mechanism 28. Prior to passing over the contacting enhancing mechanism, there exists a number of gaps 30 between the sheet 20 and the developed image 26. The gaps 30 define areas of poor contact between the sheet and the developed image. These areas of poor contact may hinder the transfer of developed image 26 from the photoconductive member 10 to the sheet 20. With continued advancement of the sheet gripper 16, the contact enhancing mechanism 28 detects the leading edge of the sheet 20 with the first sensor 70 and pivots the blade 32 about the stationary shaft 34 from its position shown in FIG. 1 to its position shown in FIG. 2. The blade 32 contacts the sheet 20 so as to cause the sheet to be urged toward and into contact with the developed image 26 as shown in FIG. 2 thereby reducing the undesirable presence of gaps 30. As a result, contact between the sheet and the developed image is enhanced as successive portions of the sheet are advanced by and in contact with the blade 32. With further advancement, the sheet passes over the corona generating device 22. The corona generating device establishes a transfer field that is effective to attract the developed image from the photoconductive member 10 to the sheet 20. The contact enhancing mechanism then detects the trailing edge of the sheet 20 with the first sensor 70 and pivots the blade 32 about the stationary shaft 34 from its position shown in FIG. 2 back to its position shown in FIG. 1.

Figure 3:
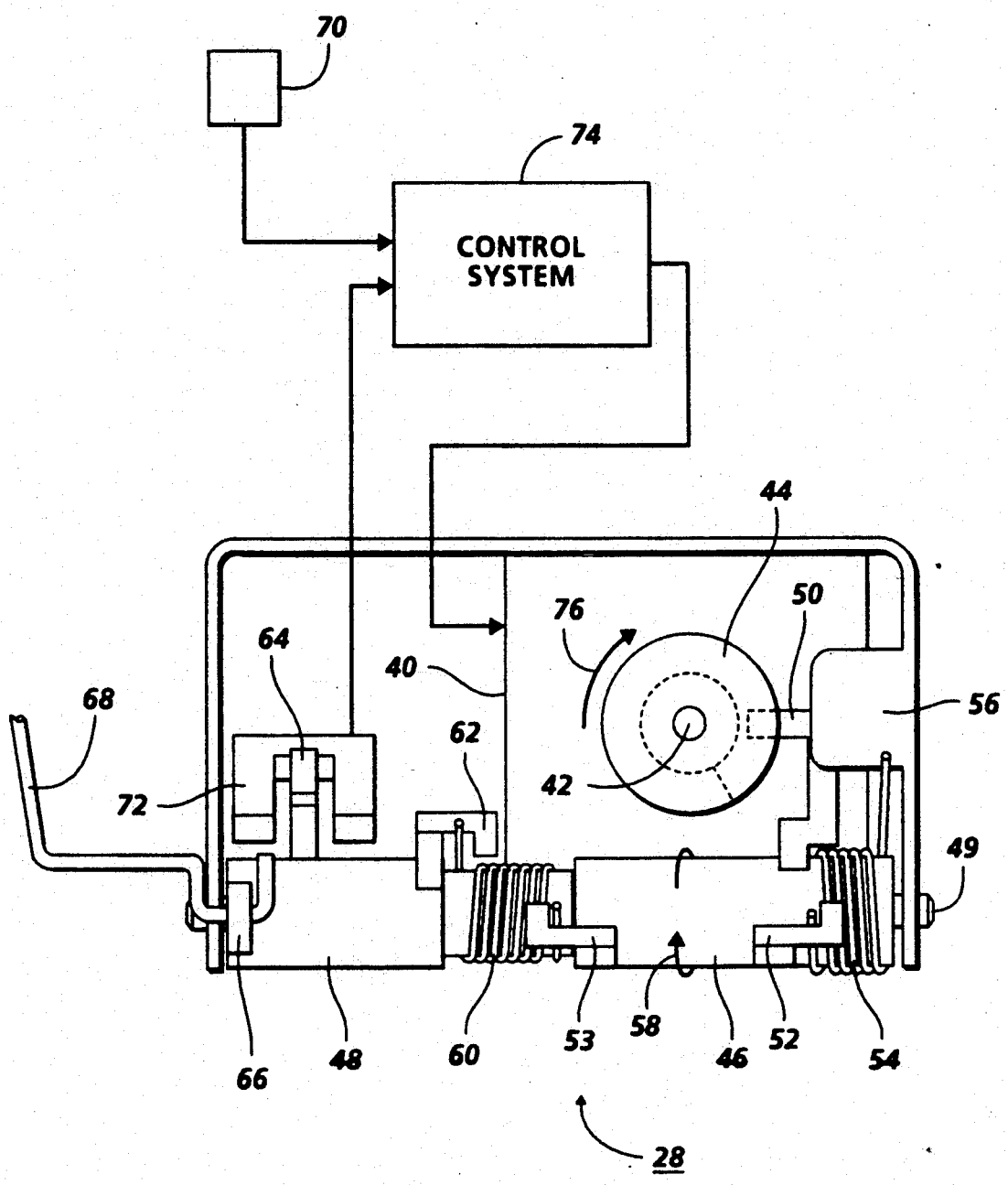
FIG. 3 is an elevational view showing various components of the contact enhancing mechanism of FIG. 1.

FIGS. 3–5 show the contact enhancing mechanism 28 in more detail. In particular, the contact enhancing mechanism includes a motor 40 which has a rotatable shaft 42. A cam member 44 is mounted on the rotatable shaft 42. The contact enhancing mechanism 28 further includes a first cylindrical link 46 and a second cylindrical link 48, each which are rotatably mounted on a stationary shaft 49. Securely mounted to the first cylindrical link 46 is a cam follower 50, a first projection 52 and a second projection 53. A third projection 62, a sensor flag 64 and a link arm 66 are each securely mounted to the second cylindrical link 48. A spring 54 is positioned around the first cylindrical link 46 and is compressed between the first projection 52 and a stationary stop 56. The spring 54 biases the first cylindrical link 46 in the direction opposite to arrow 58 (see FIG. 3). Mechanical force is transmitted from the first cylindrical link 46 to the second cylindrical link 48 via another spring 60. The spring 60 is positioned around the second cylindrical link 48 and is compressed between the second projection 53 and the third projection 62. A blade link 68 mechanically couples the blade 32 to the second cylindrical link 46 (see also FIGS. 1 and 2). The blade link 68 is connected to the second cylindrical link 48 via link arm 66. The contact enhancing mechanism 28 further includes a second sensor 72 and a control system 74. The first sensor 70 and the second sensor 72 are each electrically coupled to the control system 74, and the control system is electrically coupled to the motor 40 so as to be capable of selectively activating and deactivating the motor.

FIGS. 1, 3 and 4 each depict the position of various components of the contact enhancing mechanism 28 when the blade 32 is positioned in a first mode of operation (i.e. when the blade 32 is spaced apart from the sheet 20). FIGS. 2 and 5 each depict the position of various components of the contact enhancing mechanism when the blade 32 is positioned in a second mode of operation (i.e. when the blade 32 is in contact with the sheet 20). More specifically, when the cam member 44 is positioned at a first position as shown in FIG. 4, the blade 32 is positioned in its first mode of operation as shown in FIG. 1. As the cam member 44 is rotated for approximately $\frac{7}{8}$ths of a revolution (or about 315°) in the direction of arrow 76 to a second position as shown in FIG. 5, the blade 32 is caused to be pivoted about the stationary shaft 34 so as to be positioned in its second mode of operation as shown in FIG. 2. As the cam member 44 is further rotated for approximately $\frac{1}{8}$th of a revolution (or about 45°) in the direction of arrow 76 back to its first position as shown in FIG. 4, the blade 32 is caused to be pivoted back to its first mode of operation as shown in FIG. 1.

As stated above, when the cam member 44 is positioned at its first position as shown in FIG. 4, the blade 32 is positioned in its first mode of operation as shown in FIG. 1. The above condition exists before the first sensor 70 detects the leading edge of the sheet 20 (see FIG. 1). After the leading edge of the sheet 20 has been detected, the first sensor 70 transmits an electrical signal to the control system 74 which activates the motor 40 thereby rotating the cam member 44 in the direction of arrow 76. As the cam member 44 rotates as stated above, the sensor flag 64 is moved from its position shown in FIG. 4 until its presence is detected by the second sensor 72 as shown in FIG. 5. Upon detection of the presence of sensor flag 64, the second sensor 72 transmits an electrical signal to the control system 74 which deactivates the motor 40 thereby positioning the cam member 44 at its second position as shown in FIG. 5. This condition exists until the first sensor 70 detects the trailing edge of the sheet 20. After the trailing edge of the sheet 20 is detected, the first sensor 70 transmits an electrical signal to the control system which activates the motor thereby rotating the cam member 44 in the direction of the arrow 76. As the cam member rotates as stated above, the sensor flag 64 is moved from its position shown in FIG. 5 away from the second sensor 72 until its absence is detected by the second sensor 72. Upon detection of the absence of the sensor flag 64, the second sensor 72 transmits an electrical signal to the control system 74 which deactivates the motor 40 thereby positioning the cam member 44 back at its first position as shown in FIG. 4.

It should be noted that the movement of the blade 32 is dictated by the slope of the ramp defined by the cam member 44 upon which the cam follower 50 rides. As the cam member 44 is rotated in the direction of arrow 76, the cam follow 50 rides on the ramp defined by the cam member 44, for example, from its position shown in FIG. 4 to its position shown in FIG. 5 thereby causing the first cylindrical link 46 and consequently the second cylindrical link 48 to rotate in the direction of arrow 58. This in turn causes the link arm 66 to move from its position shown in FIG. 4 to its position shown in FIG. 5 thereby moving the blade 32 from its position shown in FIG. 1 to its position shown in FIG. 2 via blade link 68.

The ramp defined by the cam member 44 possesses two flat areas 78 and 80 (see FIG. 5) to allow for tolerance in the positioning of the cam member 44 at its first position and its second position. Such tolerance may be needed due to the potential for slight rotation of shaft 42 (and consequently cam member 44) after the motor 40 is deactivated by the control system 74.

The motor 40 should be selected such that the rotational speed of the shaft 42 causes the blade to move from its position shown in FIG. 1 to its position shown in FIG. 2 in about two seconds. By moving the blade 32 from its first mode of operation to its second mode of operation as stated above, the impact of the blade on the copy sheet will be insufficient to dislodge and displace toner positioned on the copy sheet. As a result, copy quality defects such as smudges or blurred marks near the leading edge of the copy sheet may be avoided while enabling enhanced contact between the copy sheet and the developed image during the transfer process.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. An apparatus for enhancing contact between successive, individual copy sheets and a developed image positioned on a member, comprising:

a cam movable between a first position and a second position;

means for moving said cam between the first position and the second position;

a contact member spaced apart from the copy sheet in a first mode of operation and in contact with the copy sheet in a second mode of operation;

means for advancing successive copy sheets, said advancing means being movable between the contact member and the developed image; and means for positioning said contact member spaced from the copy sheet in the first mode of operation in response to said cam being moved to the first position, and contacting the copy sheet in the second mode of operation in response to said cam being moved to the second position.

2. The apparatus of claim 1, wherein said moving means comprises a motor having a rotatable shaft.

3. The apparatus of claim 2, wherein said cam is secured to said shaft.

4. The apparatus of claim 1, wherein said positioning means comprises:

a cam follower which contacts said cam; and means for transmitting mechanical force from said cam follower to said contact member.

* * * * *